United States Patent [19]

Jackson

[11] Patent Number: 4,484,785

[45] Date of Patent: Nov. 27, 1984

[54] TUBING PROTECTOR

[75] Inventor: Joshua M. Jackson, Houston, Tex.

[73] Assignee: Sperry-Sun, Inc., Sugar Land, Tex.

[21] Appl. No.: 408,625

[22] Filed: Aug. 16, 1982
(Under 37 CFR 1.47)

Related U.S. Application Data

[63] Continuation-in-part of Ser. No. 258,209, Apr. 27, 1981, abandoned.

[51] Int. Cl.[3] ..... F16C 29/00; E21B 17/10

[52] U.S. Cl. ..... 308/4 A; 138/110; 138/111; 138/112; 175/325; 166/241

[58] Field of Search ..... 308/4 A, 4 R; 175/325; 166/241, 173; 138/110, 111, 112, 99

[56] References Cited

U.S. PATENT DOCUMENTS

| | | | |
|---|---|---|---|
| 1,736,178 | 11/1929 | Sutton | 308/4 A |
| 3,484,141 | 12/1969 | Collett | 166/241 X |
| 3,528,499 | 9/1970 | Collett | 308/4 A X |
| 3,592,515 | 7/1971 | Grant | 175/325 X |
| 3,740,801 | 6/1973 | Sears, Jr. et al. | 166/241 |
| 3,757,387 | 9/1973 | Bush et al. | 166/241 |
| 4,004,326 | 1/1977 | Beavers | 166/241 X |
| 4,042,023 | 8/1977 | Fox | 166/241 |

FOREIGN PATENT DOCUMENTS

| | | | |
|---|---|---|---|
| 627154 | 9/1961 | Canada | 308/4 A |
| 724684 | 10/1978 | U.S.S.R. | 166/241 |

OTHER PUBLICATIONS

"Corrosion Protection by Downhole Continuous Inhibitor Transmission Via External Capillary", Paper No. 268, presented at Chicago, IL to the National Association of Corrosion Engineers on 3/3-7/80.

*Primary Examiner*—Stuart S. Levy
*Assistant Examiner*—Thomas R. Hannon
*Attorney, Agent, or Firm*—Browning, Bushman, Zamecki & Anderson

[57] ABSTRACT

A device for protecting and securing small diameter tubular members along a pipe string in a wellbore is disclosed. The protector is designed to fit about the joints of connecting pipe sections and comprises a sleeve assembly capable of being arranged and locked about a pipe joint. The sleeve assembly preferably comprises a plurality of symmetrical, most preferably semicylindrical, sleeve members having interfitting longitudinal end portions, preferably held by hinge pins in circular arrangement about a pipe joint. At least one longitudinal channel is formed, preferably with a pair of parallel, longitudinal ridges on the interior surface of the sleeve assembly to receive and hold therein a small diameter tubular member. The sleeve assembly is further characterized by shoulder members spaced sufficiently far apart to bracket the greater diameter pipe joint to prevent longitudinal displacement of the sleeve assembly with relation to the pipe string and joint. Preferably, the channel includes a biasing device, most preferably a resilient or elastomeric material, to bias the tubular member against the pipe joint to prevent longitudinal and transverse movement relative thereto. Preferably, the ends of the sleeve members are formed to project inwardly, most preferably at 45 degrees, to provide both annular shoulder members and a smoother transition between the end of the sleeve assembly and the adjacent pipe section to prevent hanging in the borehole.

27 Claims, 6 Drawing Figures

TUBING PROTECTOR

This is a continuation-in-part application of co-pending application Ser. No. 258,209 filed Apr. 27, 1981 abandoned.

BACKGROUND OF THE INVENTION

This invention pertains to a tubing protector and more particularly to an apparatus for protecting small diameter tubular members secured along the outside of the joints in a pipe string to be used in a borehole.

It is often desirable to pass a small diameter tubing, capillary conduit, wire or the like (hereinafter collectively referred to as "tubular member") into a borehole to provide communication between the surface and the bottom of the borehole. For example, it may be useful to communicate downhole pressure data to the surface by transmitting the fluid pressure via a small diameter capillary tubing. Such a system is illustrated in U.S. Pat. No. 3,895,527.

Capillary tubing systems were initially developed for surface recording of bottom hole pressures. Typically, these systems were used in wells up to ten thousand feed deep and on land rather than offshore, where holes, while not straight, do not have extreme deviations.

Capillary tubing systems have also been used for the transportation of chemicals to wellbore bottoms to treat the fluids and/or formation from which such fluids are being produced. Chemical injection has been used to control corrosion in wells by continuous injection of a chemical inhibitor. The advantages gained by applying the continuous injection procedure in oil and gas wells is well known and many procedures and equipment configurations have been field tested. The two methods most widely used are kill string tubing and the injection of inhibitor packer fluid through a bottom hole valve providing a port between the casing annulus and tubing.

While capillary systems have not been used for the transmission of inhibitors or used in deep, highly deviated holes, they have been successfully used both pneumatically for surface recording of bottom hole pressures and hydraulically for injection of single component, low viscosity liquids in straight holes at relatively shallow depths.

In relatively straight holes, standard types of tubing protectors can be modified for positioning and protecting the tubular member. However, standard protectors are not suitable for use in deep, high angle, high temperature wells.

The foregoing background information is set forth in greater detail in a paper entitled, "Corrosion Protection By Downhole Continuous Inhibitor Transmission Via External Capillary," Paper No. 268 presented at Chicago, Ill. to the National Association of Corrosion Engineers on Mar. 3–7, 1980.

When the above-described tubular communication is used in a borehole, the small diameter tubular member is typically passed along the outside of the pipe string and attached thereto as the tubing or pipe string is introduced into the borehole as illustrated in U.S. Pat. No. 3,757,387. The pipe string is normally comprised of pipe sections which are coupled together with threaded connectors formed integrally on each end of the pipe sections to form a pipe joint. These pipe joints typically are of a greater diameter than the remaining portions of the pipe string. When small diameter tubing is passed along the pipe string, it must necessarily pass over each pipe joint.

As the pipe is introduced into the borehole, the large diameter joints tend to press the small diameter tubing against the wall of the borehole causing wear and damage to the tubular member. Performation or rupture may also result from twisting of an unsecured and unprotected tubular member as the drill string turns, particularly at a pipe joint where the tubular member may be pressed against the borehole wall. Additionally, an unsecured tubular member, as a result of its length and weight, may stretch and thereby deform its interior bore. Such stretching may also cause the tubular member to rupture. Therefore, it is desirable to provide a tubing protector capable of protecting and securing the tubular member at the pipe joints.

In order to provide a fit that will not slip on the pipe and which will hold the tubular member in place, it is necessary to utilize a protector that will fit the dimensions of the pipe joint. There are many types and sizes of pipe joints. Accordingly, tubing protectors in a large variety of sizes are required. The manufacture and cost of this variety of tubing protectors has been a major problem. Therefore, it is desirable to provide a protector capable of being easily and inexpensively manufactured in a wide variety of sizes.

Additionally, protectors which are oval or have outwardly projecting portions tend to hang on the borehole wall. In deviated holes, when the protector hangs, the pipe rotates within the protector thus causing the tubular member to twist and distort. Accordingly, it is desirable to provide a protector having a circular outer surface with no outwardly projecting portions and a smooth transition area from pipe string to protector to minimize hang in the borehole.

The above problems have created the need for a special type of tubing protector for use with small diameter tubular members. The present invention provides a new and improved tubing protector device which will not slip on the pipe, which will prevent wear and damage to a tubular member passing along the outside of a pipe string, which closely fits the dimension of the pipe joint connection, which performs satisfactorily in a highly deviated borehole and which is easily and inexpensively manufactured in a variety of sizes.

SUMMARY OF THE INVENTION

The tubing protector of the present invention overcomes the foregoing disadvantages and provides an easily and inexpensively manufactured apparatus for protecting the passage of small diameter tubular members along a pipe joint in a pipe string. The present invention includes a sleeve assembly capable of being arranged and locked about a joint between pipe sections. The sleeve assembly is characterized by one or more means on the inner surface thereof for receiving and holding the small diameter tubular members in a fixed relation to the pipe string and joint. The sleeve assembly is further characterized by means for preventing longitudinal displacement thereof with relation to the pipe joint.

The sleeve assembly preferably comprises a plurality of separable sleeve members capable of being arranged and locked, generally with interfitting hinge means, about a pipe joint to form a sleeve assembly. Most preferably, the separable sleeve members are semi-cylindrical with interfitting male and female hinge means located along both longitudinal edges to produce a cylindrical sleeve assembly having a circular cross section.

Means for receiving and holding the same diameter tubular members are preferably provided by one or more longitudinal channels formed on the inner surface of the sleeve assembly. In a preferred embodiment, each channel is formed between embossed, longitudinal, parallel ridges. Another feature of the invention includes the use of biasing means, preferably, a resilient or elastomeric biasing material, within the longitudinal channels for biasing the small diameter tubular member against the pipe joint to prevent longitudinal and transverse movement of the tubular member relative to the joint.

Another feature of the present invention is a means for preventing longitudinal displacement of the sleeve assembly with relation to a pipe joint. This means is provided by a plurality of inwardly projecting shoulder members formed on at least some of the sleeve members. An adjacent pair of shoulder members on each sleeve member is formed sufficiently far apart longitudinally along the sleeve member to bracket the greater diameter pipe joint when the sleeve assembly is placed about that joint. Most preferably, the displacement prevention means is provided by a pair of inwardly projecting annular shoulder members, one located at each end of the cylindrical sleeve assembly.

A further feature of the present invention includes the formation of the sleeve assembly ends or annular shoulder members thereon with radially inwardly projecting outer surfaces, preferably at approximately 45 degrees to the side wall of the sleeve assembly, to provide a smooth transition between the pipe string and protector to help prevent hang in the borehole.

The tubing protector of the present invention has many advantages. It is easily manufactured and used. It provides a device for reliably and securely receiving, retaining, and protecting small diameter tubular members about a pipe joint. The present invention provides a device capable of performing these functions at a pipe joint and of being secured from relative longitudinal movement therewith. The protectors of the present invention, having been run in holes with deviations as high as 50 degrees from vertical with excellent results, would be ideal for any deviated hole. These and other meritorious features and advantages of the present invention will be more fully appreciated from the following detailed description and claims.

While the invention will be described in connection with the preferred embodiment, it will be understood that it is not intended to limit the invention to that embodiment. On the contrary, it is intended to cover all alternatives, modifications and equivalents as may be included within the spirit of the invention as defined in the appended claims.

DETAILED DESCRIPTION OF THE PREFERRED EMBODIMENT

Figure 1:
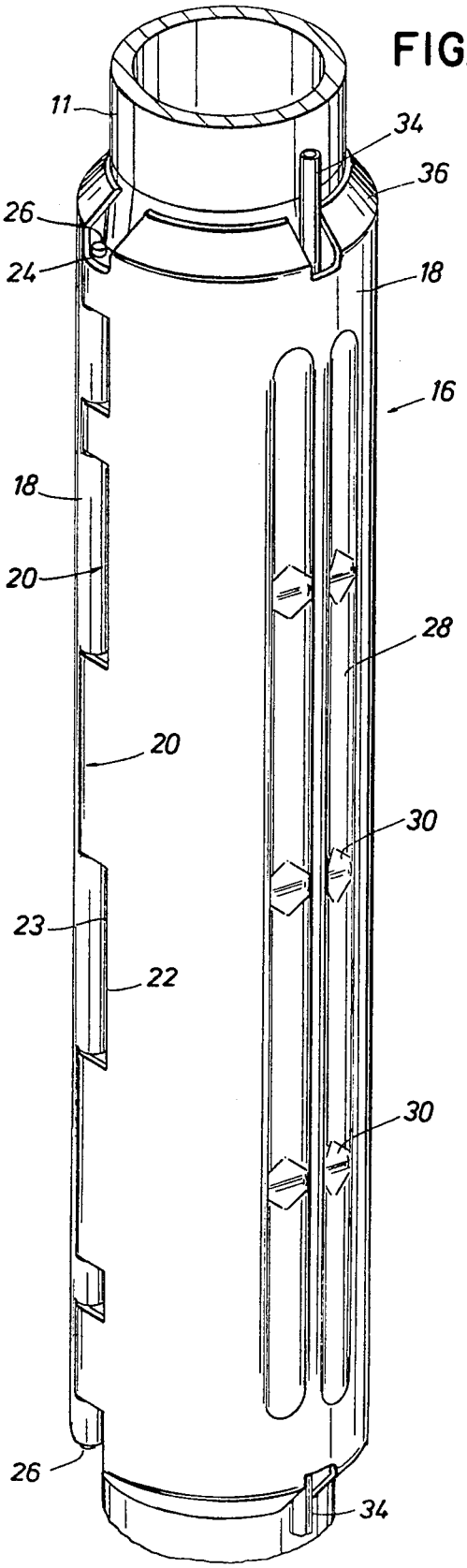
FIG. 1 is a perspective view of a tubing protector in accordance with the present invention showing a pipe joint within the protector.
Figure 3:
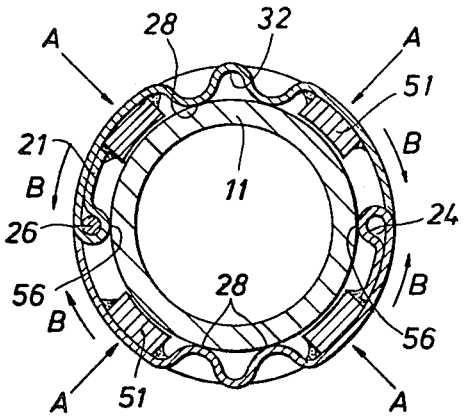
FIG. 3 is a cross sectional view of a protector positioned about a pipe joint. The points at which pressure is applied to the sleeve members to compress the sleeves and thereby expand them circumferentially to facilitate assembly over a pipe are shown at "A."
Figure 5:
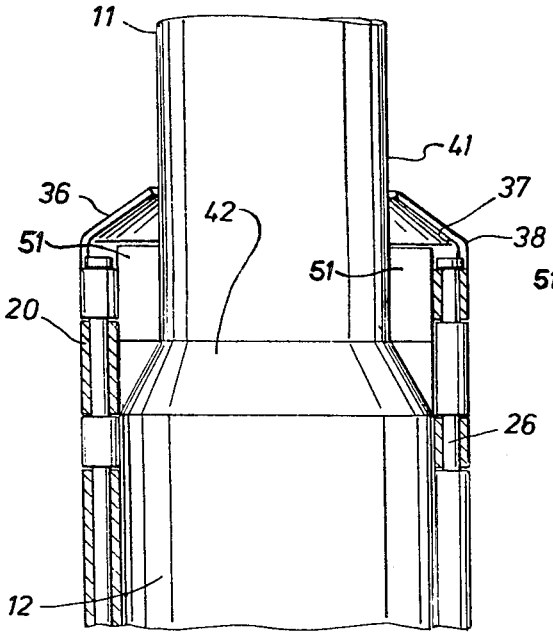
FIG. 5 is a schematic cross sectional side elevation view of a protector on a pipe joint showing the annular shoulder members formed on the ends of the sleeve members and the stops positioned within the sleeves relative to the greater diameter pipe joint.

Referring first to FIGS. 1, 3 and 5 of the drawings, a section of pipe 11 is shown having pipe joint 12 extending through a protector or sleeve assembly 16 capable of being arranged and locked about a connection between pipe sections, the joint 12 having a diameter greater than that of the pipe sections.

The protector is preferably comprised of a plurality of sleeve members 18, more preferably symmetrical sleeve members, and most preferably semi-cylindrical sleeve members, each member having hinge means 20 formed along its longitudinal edges. However, in an alternative embodiment (not illustrated), sleeve assembly 16 may be comprised of a single sleeve member 18 having hinge means 20 along a single pair of interfitting longitudinal edges and being sufficiently flexible to permit installation about pipe 11 and joint 12.

Hinge means 20 is preferably comprised of interfitting alternate male and female edge portions, respectively 22 and 23. The male portions 22 have rolled over segments 21 on their end edges. See FIGS. 2 and 3. Male portions 22 interfit with female portions 23 on the abutting longitudinal edges of sleeve members 18. The rolled over segments 21 form a longitudinal circular channel 24 which is arranged to receive hinge pin 26 extending through interfitting male portions 22 to hold sleeve members 18 in assembly about a pipe joint 12. Although this hinge means is preferred because of its simplicity, those skilled in the art will know of many hinge means which may be used. For example, other hinge means may employ tapered hinge pins.

At least one sleeve member 18 includes on its inner surface one or more means for receiving and holding the small diameter tubular members 34 in a fixed relation to the pipe string. In a preferred embodiment, the exterior walls of sleeve members 18 are embossed, preferably midway between their longitudinal edges to form parallel, longitudinal, concave ridges 28. In another feature of the present invention, concave ridges 28 are interrupted with strengthening means along their length to improve the longitudinal bending properties of sleeve members 18. The strengthening means include braces 30 and the like.

In a preferred embodiment, concave channel 32 (FIG. 3) formed between embossed ridges 28 on the inner surface of sleeve member 18 provides the means for receiving and holding the small diameter tubular members 34 in a fixed relation to the pipe string. Channel 32 is uninterrupted throughout its length and serves as a protective groove in which a small diameter tubular member 34 such as a capillary tubing, may be housed. Channel 32 preferably extends as far as practical along the longitudinal length of sleeve member 18. One or more channels 32 may be formed in each sleeve member 18. Preferably, each member 18 includes one channel 32 formed midway between the longitudinal edges of member 18.

Preferably, the ridges and hinges are arranged so that they form symmetrical contact points about the circumference of pipe joint 12 when sleeve members 18 are assembled on pipe 11. These contact points serve as spacers to maintain the preferred circular configuration of sleeve assembly 16 when assembled on pipe 11 about joint 12 and also serve as fulcrum points when sleeve members 18 are compressed about pipe joint 12 to facilitate assembly thereon.

Sleeve assembly 16 further comprises a means for preventing longitudinal displacement of the protector with relation to pipe joint 12. This means comprises a plurality of inwardly projecting shoulder members 36 formed on at least some of sleeve members 18. An adjacent pair of shoulder members 36 on each sleeve member 18 is formed sufficiently far apart longitudinally along sleeve member 18 to bracket the greater diameter joint 12 of pipe 11 when sleeve assembly 16 is placed about the joint. In a preferred embodiment, this means is provided by a pair of annular shoulder members 36 formed at each end of cylindrical sleeve assembly 16. Shoulder members 36 must project inwardly at least within the circumference of joint 12.

In a presently preferred embodiment, shoulder members 36 extend inwardly from the ends of sleeve assembly 16, most preferably at an angle of approximately 45 degrees from the outer wall of the sleeve assembly as shown at 37, to provide a smooth transition region between the protector and the pipe string by forming a smooth radius at 38. This configuration minimizes or eliminates the hanging up of the protector on the sides of the borehole.

Most preferably, shoulder members 36 are spaced slightly from or in contact with pipe joint 12 along cylindrical pipe wall 41 adjacent the conical transition region 42. Shoulder members 36 include stops or tabs 51 projecting radially inwardly from the inner surface of sleeve members 18. The inside surfaces of stops 51 are spaced slightly from cylindrical outer wall 41 of pipe 11. Movement of sleeve assembly 18 along the axis of pipe 11 brings the inner edges of tabs 51 into contact with conical transition region 42., directing a portion of the force of abutment therebetween into a radially outward component. Sleeve assembly 16 has its strongest resistance to deformation in this direction, enhancing the resistance of the protector to longitudinal movement.

Figure 6:
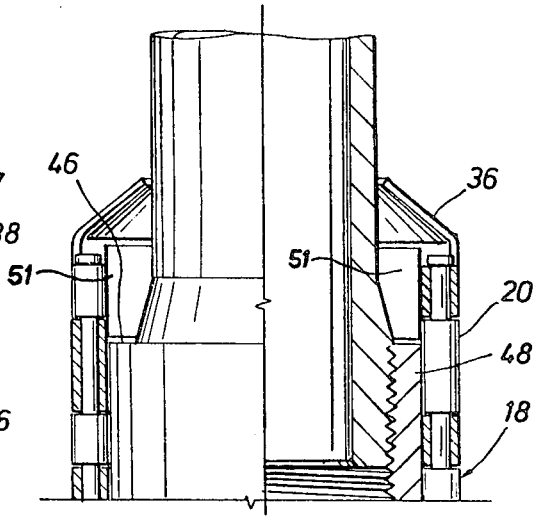
FIG. 6 is a fragmentary cross sectional elevational view of the annular shoulder members formed on the end of the sleeve members and the stops positioned within the sleeves relative to another configuration of a pipe joint.

Another type of pipe joint, an API external upset joint, is illustrated in FIG. 6. The API external upset joint has a more accentuated shoulder 46 formed on outer portion 48 of the pipe joint. With this joint, stops or tabs 51 contact shoulder 46 directly to prevent longitudinal and axial movement of the protector with relation to the pipe joint.

Figure 2:
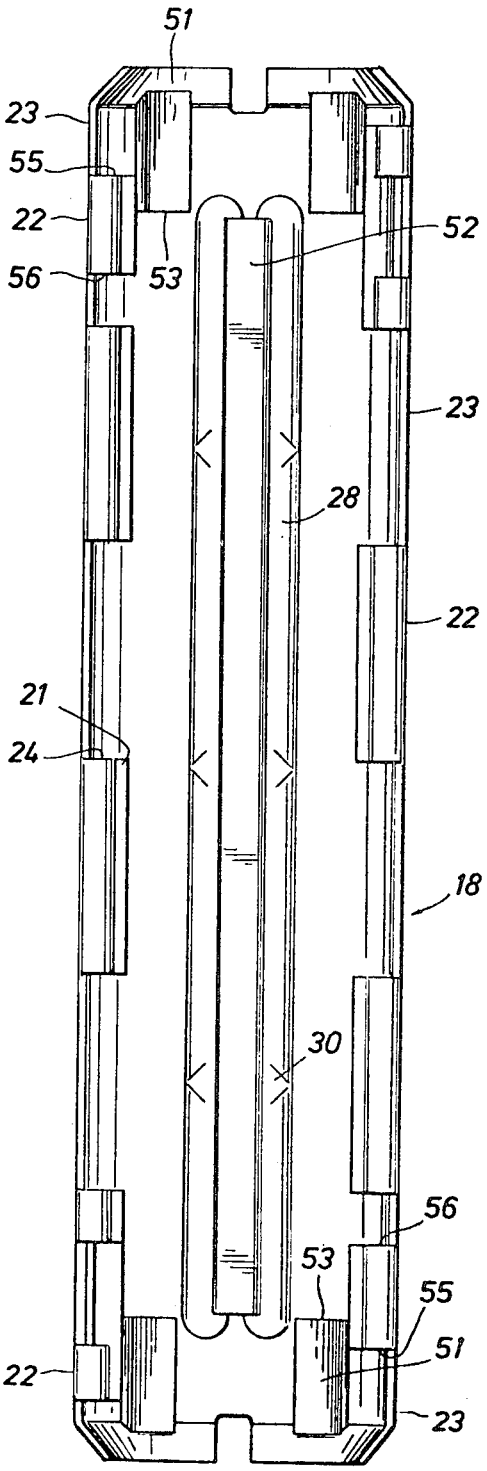
FIG. 2 is a side elevation view showing the interior surface of one of a pair of individual sleeve members which forms a protector.
Figure 4:
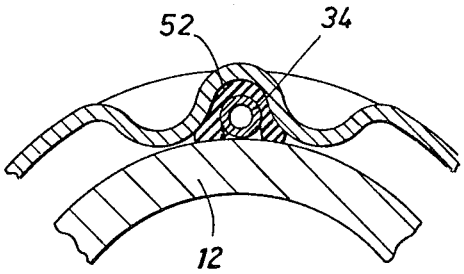
FIG. 4 is a fragmentary cross sectional view of a sleeve member and pipe joint showing a capillary tube held between the protector and the pipe.

Sleeve assembly 16 further includes in a presently preferred embodiment a means within channel 32 for biasing tubular member 34 against joint 12 to prevent longitudinal and transverse movement relative thereto. Referring now to FIGS. 2 and 4 of the drawings, a strip of resilient or elastomeric material 52 is positioned in channel 32 on the inner surface of sleeve member 18. In assembly with pipe 11, resilient material 52 serves to bias tubular member 34 against the outer wall of pipe joint 12. This biasing action maintains the tubing in place against pipe joint 12, preventing longitudinal and transverse movement of tubular member 34. The total weight of tubular member 34 in a deep well is substantial and may deform or separate the tubing if it is allowed to hang unsupported. Therefore, it is important to maintain both longitudinal and transverse support of tubular member 34.

Referring again to FIGS. 2 and 3 of the drawings, particular attention is drawn to the preferred symmetrical configuration of semi-cylindrical sleeve member 18, which when assembled with another identical sleeve member provides sleeve assembly 16 for protecting tubular member 34. In a preferred embodiment, sleeve member 18 is formed so that male and female hinge portions, respectively 22 and 23, are equidistant from the center of channel 32 formed by ridges 28. This symmetrical configuration lends itself to the manufacture of sleeve members 18 of various diameters in an adjustable die with the edges of sleeve members 18 being dimensioned away from the central channel 32. Thus, the edges of the forming die are adjusted either laterally or longitudinally away from the center of the die respectively to provide for a larger diameter or a longer sleeve member. Due to the wide variety of pipe sizes and joint configurations which are used in borehole operations, this becomes an important feature in minimizing the cost of the protector.

FIG. 2 illustrates the use of shorter hinges near the ends of sleeve members 18. The interfitting edge portions of sleeve members 18 have smaller lengthwise dimensions (FIGS. 1 and 2) near the ends of the sleeves to strengthen the sleeves against bending. This arrangement prevents a large female portion 23 from being positioned near and weakening the end of sleeve member 18. The ends of sleeve member 18 are thus strengthened against deformation about the corner formed by the longitudinal and end edges of sleeve members 18. Deformation in this area would tend to expand sleeve assembly 16 over pipe joint 12.

Further, the protector is subjected to significant longitudinal forces when being lowered into the borehole. Shown in FIGS. 2, 3 and 5 are reinforcing stops or tabs 51, positioned on the inner ends of sleeve members 18 to contact pipe 11 when assembled thereon and focus any bending moment applied to the sleeve ends at a point on the interfitting edge portions between interfitting mating edges. The edges 53 of stops or tabs 51 and their abutment with pipe joint 12 become an important feature to redirect a portion of these forces radially.

Tabs 51, preferably formed of metal, are attached to the inner wall of sleeve members 18 inward of shoulder members 36 and between the hinge means and embossed ridges 28. Tabs 51 direct a portion of the force of abutment between pipe joint 12 and sleeve assembly 16 in a radially outward direction where the cylindrical sleeve assembly has its strongest resistance to deformation. This provides greater resistance against the ends of the sleeve assembly 16 being peeled back over pipe joint 12 when a longitudinal force tries to displace the assembly along the axis of pipe 11 and over pipe joint 12. Stops or tabs 51 are preferably arranged so that their inner lateral edges 53 are longitudinally aligned with a point between, and most preferably midway between, the lateral edges, respectively 55 and 56, of the second hinge portion from the ends of sleeve members 18. Tabs 51 tend to engage the outside of the pipe transition region 42 before other parts of the protector and thus, if relative motion occurs between pipe 11 and sleeve assembly 16, inner edges 53 of tabs 51 tend to serve as fulcrums for any bending moment applied to the protector. Since inner edge 53 is aligned with a point somewhere between the ends 55 and 56 of the second hinge portion from the ends of sleeve members 18, the bending moment is not applied to the less strong edge portions 55 and 56 of the hinges.

FIG. 3 illustrates another feature of the invention pertaining to the contact points formed by the hinges at 56 and ridges 28. These inward projections space the sleeves about the joint 12 when assembled to form and maintain a circular cross section for the outer surface of sleeve assembly 16. In deviated boreholes there is a tendency for the pipe to twist as it is run into the hole. When the protector does not have an outer surface with a circular cross section or when the outer surface has projections outside its circular surface, such projections or out of round surfaces tend to hang up on the wall of the borehole and cause the pipe string to rotate in the protector. This rotation fouls tubular member 34 in the hole, possibly causing the tubing to deform or sever.

The protector of the present invention is held about pipe joint 12 by an interference type fit, attained by using a special installation tool during mounting to the pipe to clamp or squeeze the protector. This level of interference is maintained by the retaining hinge pin configuration. The protector units are specifically sized to various pipe and joint sizes to assure the interference type make-up. Installation of the protectors is a simple process requiring 20 to 30 seconds per joint.

FIG. 3 also aids in understanding assembly of sleeve members 18 about pipe joint 12. In the presently preferred embodiment having symmetrical, semi-cylindrical sleeve members 18, pin 26 is initially inserted into openings 24 in one of the mated edges of a pair of sleeve members 18. Sleeve members 18 are then hinged closed in a swinging motion about pipe joint 12 with shoulder members 36 arranged near the transition portion 42 (shown in FIG. 5) of joint 12. In the most preferred embodiment, the free edges of sleeve members 18 will not meet of their own accord to be clamped about pipe 11. Therefore, a clamping force is applied simultaneously to the points "A" as shown in FIG. 3 along the longitudinal face of the sleeves with a special tool (not shown). This force compresses sleeve members 18 against pipe joint 12 at bearing points formed by embossed ridges 28 and the inner edge 56 of the hinges. This compression of sleeve members 18 at points "A" between the bearing points causes the longitudinal edges of sleeve members 18 to move in the direction of arrows B. Since the already hinged edges on one side of assembly 16 are fixed relative to one another, the free edges close toward one another. When the free edges have closed to the extent that openings 24 in overlapping male portions 22 are aligned, another pin 26 is inserted in openings 24, clamping sleeve assembly 16 about pipe joint 12. The force at points "A" is then removed and the assembly is lowered into the borehole until a subsequent pipe joint 12 is ready to be interconnected into the drill string and the procedure outlined above is repeated.

The foregoing description of the invention has been directed in primary part to a particular preferred embodiment in accordance with the requirements of the patent statutes and for purposes of explanation and illustration. It will be apparent, however, to those skilled in the art that many modifications and changes in this specific apparatus may be made without departing from the scope and spirit of the invention. For example, hinge means employing taper, hinge pins may be substituted for the hinge means described and illustrated. Many means of receiving, holding and biasing the tubular members on the inner surface of the protector may be formulated by those skilled in the art. Therefore, the invention is not restricted to the particular form of construction illustrated and described, but covers all modifications which may fall within the scope of the following claims.

It is Applicant'intention in the following claims to cover such modifications and variations as fall within the true spirit and scope of the invention.

What is claimed is:

1. An apparatus for protecting one or more small diameter tubular members secured along the outside of a string of tubular pipe sections, comprising:

a plurality of separable sleeve members capable of being arranged and locked to form a sleeve assembly about a joint between pipe sections, said joint having a diameter greater than that of said pipe sections;

one or more means for receiving and holding said small diameter tubular members in a fixed relation to said pipe string formed on the inner surface of at least one sleeve member; and hinge means on each of said separable sleeve members and pin means insertable in said hinge means for holding said members in assembly, wherein said hinge means and said receiving and holding means are arranged to project radially inwardly from said sleeve members to provide contact points for biasing against said joint when said sleeve members are arranged in assembly about said joint.

2. The apparatus of claim 1 wherein said sleeve assembly further includes means for preventing longitudinal displacement thereof with relation to said greater diameter joint.

3. The apparatus of claim 2 wherein said means for preventing longitudinal comprises a plurality of inwardly projecting shoulder members formed on at least one of said sleeve members.

4. The apparatus of claim 3 wherein said means comprises two shoulder members on each sleeve member, said shoulder members formed sufficiently far apart longitudinally along said sleeve member to bracket said greater diameter joint when said sleeve assembly is arranged and locked about said joint.

5. The apparatus of claim 4 wherein said shoulder members are annular and formed at each end of said sleeve assembly.

6. The apparatus of claim 5 wherein the outer surface of said annular shoulder members extends radially inwardly of said sleeve members at an angle of approximately 45 degrees to the side wall of said sleeve members.

7. The apparatus of claim 5 and further including stiffening means formed on the interior wall of said sleeve members adjacent to said annular shoulder members, with the inner lateral edge of said stiffening means being positioned approximately midway between said contact points.

8. The apparatus of claim 4 wherein said shoulder members further include stop means projecting radially inwardly from the inner wall of said sleeve member and having an inner surface capable of engaging said pipe sections or said joint to resist longitudinal movement of said sleeve members with respect to said pipe string, said stop means formed on both sides of a zone sufficiently wide to receive therein said greater diameter joint.

9. The apparatus of claim 3 wherein the most interior surface of all of said shoulder members when said sleeve assembly is arranged about said joint has a diameter less than the outer diameter of said joint.

10. The apparatus of claims 1 further including biasing means disposed in said receiving and holding means for biasing said small diameter tubular members against said pipe string and joint, thereby holding said tubular member in a fixed relation to said joint.

11. The apparatus of claim 9 wherein said biasing means is a resilient material.

12. The apparatus of claim 1 wherein said contact points are arranged symmetrically about said pipe string.

13. An apparatus for protecting one or more small diameter tubular members secured along the outside of a string of tubular pipe sections, comprising:

a plurality of separable sleeve members capable of being arranged and locked to form a sleeve assembly about a joint between pipe sections, said joint having a diameter greater than that of said pipe sections; and one or more means for receiving and holding said small diameter tubular members in a fixed relation to said pipe string formed on the inner surface of at least one sleeve member, wherein said receiving and holding means comprises channels formed between parallel, longitudinal ridges embossed on the outer surface of said sleeve members.

14. The apparatus of claim 13 wherein said embossed ridges are interrupted between their ends by means for strengthening said sleeve members.

15. An apparatus for protecting the passage of one or more small diameter tubular members about the outside of a pipe string, comprising:

a plurality of sleeve members arranged to form a sleeve assembly having a circular outer configuration when assembled about said pipe string, said sleeve members having longitudinal edges arranged in interfitting male and female portions to provide hinge means, said male and female portions immediately adjacent the ends of each of said sleeve members being of a smaller longitudinal dimension along the longitudinal edge of said sleeve members than the longitudinal dimension of the remaining male and female portions;

one or more longitudinally arranged channels on the inner surface of at least one of said sleeve members, said channels sized to receive and hold said small diameter tubular members; and annular shoulder members on each end of said sleeve assembly, said shoulder members formed sufficiently far apart to receive a greater diameter pipe joint therebetween, the outer surface of said shoulder members projecting inwardly to provide a smooth transistion region between said sleeve assembly and said pipe string.

16. The apparatus of claim 15 further comprising tabs extending radially inwardly from the interior wall of said sleeve members adjacent said annular shoulders, said tabs formed on both sides of a zone sufficiently wide to receive therein said greater diameter pipe joint, the inner lateral edges of said tabs located between the lateral edges of the second hinge portion from the ends of said sleeve members.

17. The apparatus of claim 16 wherein said sleeve members are semi-cylindrical.

18. The apparatus of claim 16 wherein each of said male and female portions have longitudinally formed-over portions, and further including pin means for insertion in said formed over portions for holding said sleeve members in assembly about said pipe.

19. The apparatus of claim 18 wherein said channels are formed between longitudinal ridges embossed in said sleeve members, said ridges and hinge means forming longitudinal contact points with said pipe joint when assembled therewith.

20. The apparatus of claim 19 wherein said contact points formed by said hinge means and said ridges are symmetrically arranged about said pipe joint and serve to space said sleeve members about said pipe joint to form a circular configuration on the outer surface of said sleeve members when assembled.

21. An apparatus for protecting one or more small diameter tubular members secured along the outside of a string of tubular pipe sections, comprising:

a sleeve assembly capable of being arranged and locked about a pipe section;

hinge means along the longitudinal edges of said sleeve assembly and pin means insertable in said hinge means for locking said assembly about said pipe section; and one or more means on the inner surface of said sleeve assembly for receiving and holding said small diameter tubular members in a fixed relation to said pipe string, wherein at least one of said hinge means and at least one of said receiving and holding means are arranged to project radially inwardly from said sleeve assembly to provide contact points for biasing against said pipe section when said sleeve assembly is arranged about said pipe section.

22. An apparatus for protecting one or more small diameter members secured along the outside of a string of tubular pipe sections, comprising:

a pair of semi-cylindrical, symmetrical, separable sleeve members capable of being arranged and locked to form a sleeve assembly about a joint between pipe sections, said joint having a diameter greater than that of said pipe sections;

hinge means along the longitudinal edges of said sleeve members to interfit and lock said members together;

longitudinal channels for receiving said small diameter tubular members formed symmetrically in the inner surface of said sleeve members, said channels formed between parallel, longitudinal ridges embossed in the outer surface of said sleeve members, said channels and hinge means located symmetrically about said sleeve assembly, said embossed ridges and said hinge means forming contact points with said pipe joint when in arrangement therewith;

inwardly projecting annular shoulder members formed at each end of said sleeve assembly for preventing longitudinal displacement of said sleeve assembly with relation to said joint, said shoulder members formed outside of a zone sufficiently wide to receive therein said greater diameter joint when said sleeve assembly is placed about said joint; and resilient biasing means in said channels for biasing said small diameter tubular members against said pipe string and joint thereby holding said small diameter tubular member in a fixed relation to said joint.

23. The apparatus of claim 22 further including biasing means disposed in said receiving and holding means for biasing said small diameter tubular members against said pipe section.

24. The apparatus of claim 23 wherein said biasing means is a resilient material.

25. The apparatus of claim 22 wherein said sleeve assembly is adapted to be arranged and locked about a joint between pipe sections, said joint having a diameter greater than that of said pipe sections.

26. The apparatus of claim 25 wherein said sleeve assembly further includes means for preventing longitudinal displacement of said sleeve assembly with relation to said greater diameter joint.

27. The apparatus of claim 26 further including biasing means disposed in said receiving and holding means for biasing said small diameter tubular members against said pipe sections.

* * * * *

UNITED STATES PATENT AND TRADEMARK OFFICE

CERTIFICATE OF CORRECTION

PATENT NO. : 4,484,785

DATED : November 27, 1984

INVENTOR(S) : Joshua M. Jackson

It is certified that error appears in the above—identified patent and that said Letters Patent is hereby corrected as shown below:

In Column 9, line 13, delete "9" and insert therefor --10--.

In Column 11, line 6, delete "22" and insert therefor --21--.

In Column 12, line 1, delete "22" and insert therefor --21--.

Signed and Sealed this

*Twenty-third* Day of *April 1985*

[SEAL]

*Attest:*

DONALD J. QUIGG

*Attesting Officer*

*Acting Commissioner of Patents and Trademarks*